US005830024A

United States Patent [19]

Killen et al.

[11] Patent Number: 5,830,024

[45] Date of Patent: Nov. 3, 1998

[54] BOAT PADDLE HAVING LATERAL FORCE TRANSMITTING RIB

[76] Inventors: William P. Killen, 46 Merriel, Dayton, Tex. 77535; Ormond S. Douglas, Rte. 1, Box 448, Livingston, Tex. 77351

[21] Appl. No.: 897,712

[22] Filed: Jul. 21, 1997

Related U.S. Application Data

[60] Provisional application No. 60/022,427 Aug. 5, 1996.

[51] Int. Cl. [6] ..... G63H 16/04

[52] U.S. Cl. ..... 440/101; 416/70 R

[58] Field of Search ..... 440/101; 416/69, 416/70 R, 74; D12/215

[56] References Cited

U.S. PATENT DOCUMENTS

| | | | |
|---|---|---|---|
| 2,589,698 | 3/1952 | Jackson | 416/74 |
| 3,188,011 | 6/1965 | Decker | 416/70 R |
| 4,303,402 | 12/1981 | Gooding | 440/101 |
| 4,610,633 | 9/1986 | Freudenberg | 440/101 |

FOREIGN PATENT DOCUMENTS

| | | | |
|---|---|---|---|
| 26 04 597 | 8/1977 | Germany | 440/101 |

*Primary Examiner*—Sherman Basinger
*Attorney, Agent, or Firm*—Bush, Riddle & Jackson L.L.P.

[57] ABSTRACT

A paddle for watercraft is provided which has an elongate shaft on which is provided a handle. A blade is in fixed relation with the paddle handle and defines blade edges and opposed blade sides. A lateral force transmitting steering rib projects from one of the blade side faces and is oriented in substantially normal relation therewith. The lateral force transmitting steering rib extends from the free terminal end of the paddle blade, opposite the connection of the handle with the blade and extends along the longitudinal axis of the blade a distance of from about one-third of the length of the blade to about one-half of the length of the blade. The lateral force transmitting steering rib may extend along the entire length of the paddle blade if desired.

5 Claims, 1 Drawing Sheet

FIG. 1
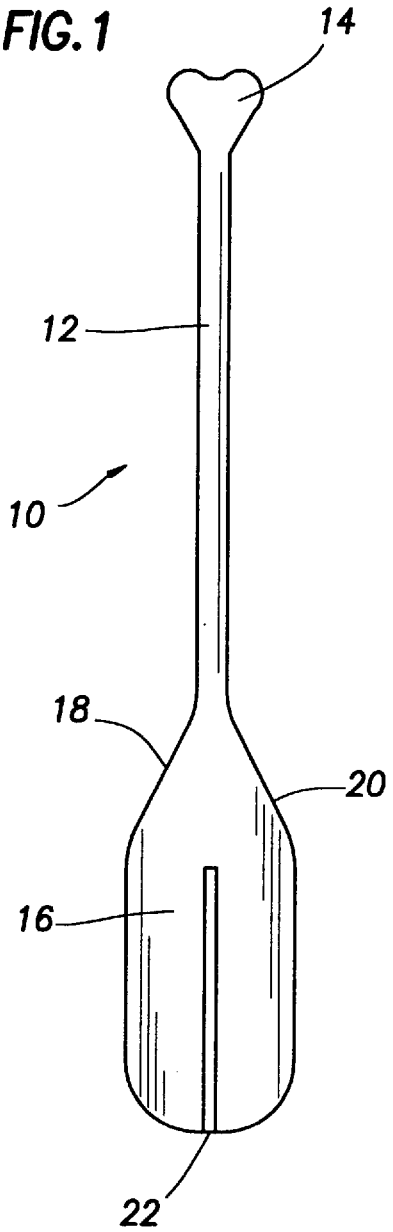
FIG. 2
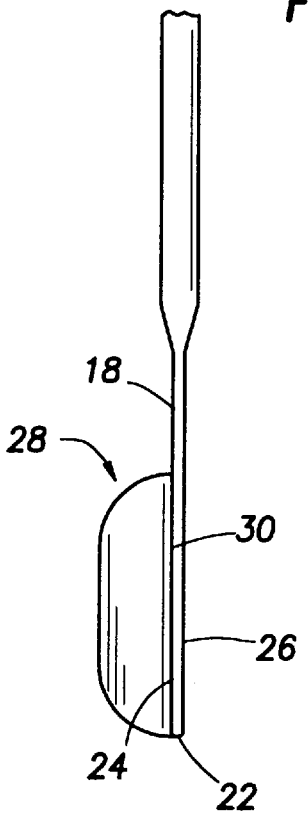
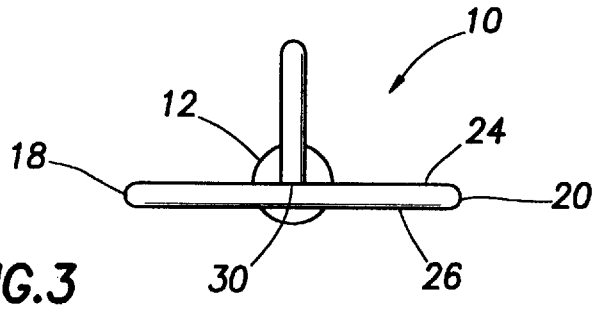
FIG. 3

BOAT PADDLE HAVING LATERAL FORCE TRANSMITTING RIB

CROSS-REFERENCE TO RELATED APPLICATION

This application claims the benefit of provisional application Ser. No. 60/022,427 of William P. Killen and Ormond S. Douglas, filed Aug. 5, 1996 and entitled Boat Paddle Having Lateral Force Transmitting Rib.

FIELD OF THE INVENTION

This invention relates generally to boat paddles for manually moving small boats, canoes or the like on bodies of water. More specifically, the present invention concerns a boat paddle having a laterally extending axially oriented force rib which extends in substantially normal relation with and centrally from the rear face of the blade of the paddle and enables the user to provide an energy efficient lateral force against the water at the terminal portion of a paddling stroke to counteract the turning or curved course of a boat as the result of the force that is caused by a paddling stroke on one side of the boat.

DESCRIPTION OF THE PRIOR ART

Small boats, such as skiffs, canoes, kayaks and the like are often moved on the surface of a body of water by manual force that is applied with a paddle. Though skiffs are for the most part moved on the water by a pair of oars that are received by oarlocks mounted to the gunwale of the skiff, with manual force being applied to handles of the oars, pivoting the shafts of the oars in the oarlocks and moving the blades of the oars against the water to propel the skiff. Since force to propel the skiff is applied simultaneously on both the port and starboard sides of the skiff it will be for the most part propelled in a generally straight line. If the skiff or any other boat is propelled through the use of a single oar or paddle, when force is applied by the oar or paddle on one side of the skiff the force tends to propel the skiff or boat along a curved path or course, curving toward the side opposite the side on which the paddling stroke is occurring. To counteract this tendency of the boat to curve away from the side where the force is being applied by the paddle, the user will typically switch sides with the paddling activity to bring the boat back to the intended straight course. In fact, the user will typically paddle from one to three strokes on one side, switch sides and paddle from one to three strokes on the opposite side. In this case the actual track of the boat on the water is a serpentine path averaging the intended course. In the case of kayaks, which are typically paddled through the use of a double bladed paddle having a shaft with paddle blades at each of its ends, the user in this case will hold the double bladed paddle by its shaft and alternate paddling strokes with the blades. The track of the kayak, however will still have serpentine characteristics, but the variation from the intended straight course will not be as great as compared to paddling through the use of multiple strokes on one side before switching sides with the paddle because of the alternating paddling strokes of the double bladed paddle. Obviously, the boat will be required to travel a greater distance from its starting point to its destination when paddling in this manner because of the serpentine path that the boat actually travels in response to paddling on alternating sides with the double bladed kayak paddle.

In an effort to minimize the curved track that occurs as a canoe is paddled on one side and to also minimize the need for alternating side paddling strokes, canoe users will often employ the "J" stroke with a single paddle. A conventional paddle is used and is turned outwardly at the end of each paddling stroke. When turned outwardly the blade of the paddle will be oriented essentially parallel with the intended track of the canoe. With the canoe paddle so oriented the user will then apply an outwardly directed paddle force component, essentially pushing the paddle against the water and away from the canoe. This force component counteracts the turning movement of the canoe which is caused by the initial portion of the "J" stroke, thus bringing the canoe back to its intended substantially straight track. A disadvantage of the "J" stroke is that the outwardly directed force component of the stroke actually retards the forward motion of the canoe so that some of the users energy that is expended for moving the canoe is counteracted by user energy that is expended for course correction. Another disadvantage of the "J" stroke is that it is difficult to master and that it is excessively tiring because the outwardly pushing for component at the end of the stroke is accomplished at an awkward body position and because the paddle must be manually rotated against the resistance of the water during the end portion of the stroke. A significant energy loss will occur as the paddle blade is being rotated relative to the water for accomplishing the "J" stroke. The tendency is for the user to correct the curving course of the canoe by using the paddle as a rudder at the end of each paddling stroke. The disadvantage of this activity is that the paddle, when used as a rudder for course correction steering actually slows the forward movement of the canoe, thus detracting from the energy that is expended in propelling the canoe forwardly. It is desirable to provide means for paddling a boat, canoe or the like so that a single paddling stroke will accomplish forward propulsion of the boat and will apply an outwardly directed force component at the end of the stroke for course correction without necessitating rotation of the paddle during the paddling stroke and without requiting the user to push laterally at the end of the stroke to accomplish course correction.

SUMMARY OF THE INVENTION

It is a primary feature of the present invention to provide a manually used paddle for small boats such as canoes, skiffs and the like which will a user to paddle on one side of the boat for both propulsion and course correction without necessitating the use of the "J" stroke.

It is another feature of the present invention to provide a manually used paddle that can be pivoted against the gunwale of the boat at the end of a normal paddling stroke and without rotating the paddle, for the purpose of providing energy efficient course correction force that is needed to maintain a substantially straight course on a body of water.

It is an even further feature of the present invention to provide a manually used paddle having a paddle blade at one end of an elongate paddle shaft and further having a lateral force transmitting rib mounted to the blade in such manner that, without requiring rotation of the paddle, it can be pivoted intermediate its ends against the gunwale of the boat to develop a lateral force against the water that will correct the course of the boat and maintain it on a substantially straight course.

The various features of the present invention are achieved by a boat paddle having an elongate shaft with a handle at one end and a paddle blade at the opposite end. The paddle blade is oriented in conventional manner with respect to the handle and defines a central axis essentially parallel with or coextensive with the elongate paddle shaft. A lateral force transmitting rib is fixed to the blade of the paddle along the central axis of the blade and is oriented in substantially normal relation with the blade. The lateral force transmitting rib can extend the complete length of the paddle blade but preferably extends from the free end of the paddle blade to a location intermediate the inner and outer ends of the blade because, during a major portion of the paddling stroke the upper portion of the paddle blade will be out of the water. By locating the lateral force transmitting rib at the free or lower end of the paddle blade and by limiting its length to from about one-half to about two-thirds of the length of the paddle blade, during a majority of the paddling stroke the lateral force transmitting rib will be located beneath the water and in position for transmitting lateral force from the paddle to the water without necessitating rotation of the paddle by the user. The lateral force transmitting rib is of sufficient dimension, i.e. length and width, that desired lateral force is applied thereby to the water upon pivoting the paddle shaft against the gunwale of the boat to cause a desired degree of course correction. During user of the paddle, the lateral force transmitting rib is positioned forwardly or toward the direction of the bow of the boat. Thus, as the paddle is moved rearwardly by manual force applied by the user, the lateral force transmitting rib will not be applying any sort of force to the water. It will apply lateral force to the water only when it is pivoted against the gunwale of the boat in a manner that moves the blade of the paddle laterally away from the boat. The paddling stroke, with the paddle of the present invention is a paddle movement generally straight along the side of the boat, with all of the manual force being applied to drive the boat forwardly in the water. Application of lateral force to the water by pivoting of the paddle against the gunwale of the boat occurs only for the purpose of course correction at the end portion of each paddling stroke so that the general course of the boat is a straight line.

BRIEF DESCRIPTION OF THE DRAWINGS

The various objects and advantages of this invention will become apparent to those skilled in the art upon an understanding of the following detailed description of the invention, read in light of the accompanying drawings which are made a part of this specification and in which:

FIG. 1 is an isometric illustration of a boat paddle constructed in accordance with the present invention and having a lateral force transmitting rib projecting in substantially normal relation from the blade thereof.

FIG. 2 is a partial side elevational view of the paddle of FIG. 1, showing the relationship of the lateral force transmitting rib to the blade thereof FIG. 3 is a sectional view taken along line 3—3 of FIG. 1 and further showing the relationship of the lateral force transmitting rib to the blade thereof.

DETAILED DESCRIPTION OF PREFERRED EMBODIMENT

Referring now to the drawing and first to FIG. 1 a boat paddle constructed in accordance with the present invention is shown generally at 10 and has an elongate paddle shaft 12 having a handle 14 located at one end thereof and adapted to be grasped by one hand of a user who will also grasp the shaft with the other hand at a suitable location intermediate the ends of the shaft. The handle is in the form of a knob that is designed to comfortably fit the hand of the user. The paddle is also provided with a paddle blade 16 having elongate blade sides or edges 18 and 20 that merge with the elongate shaft at the upper end thereof and curve outwardly and downwardly so as to define a paddle blade of desired width. The paddle blade defines a free end 22 and defines side surfaces 24 and 26. The paddle blade is of thin configuration with the side surfaces 24 and 26 being spaced less than the cross-sectional diameter of the paddle shaft. Though the paddle blade can be of any suitable length for the size of the boat to be propelled thereby, for purposes of explanation of this invention the paddle blade may be in the order or 18" in length and ½" in width.

At the free end portion of the paddle blade 18 a lateral force transmitting rib shown generally at 28 is mounted to the side surface or face 24 of the paddle blade and extends from the free end 22 of the paddle blade to a location intermediate the length of the paddle blade. For example, for a paddle blade 18" in length, the lateral force transmitting rib may be in the order of from about 5" to about 9" in length and may have a width in the range of from about 2" to about 5". Preferably, for a paddle blade having a length of 18", the lateral force transmitting steering rib will have a length of about 7" and may project outwardly from the face of the paddle blade about 3½". The lateral force transmitting rib may also have a thickness in the order of about ½" and may define parallel side face surfaces that are oriented in substantially parallel relation with one another and in substantially perpendicular relation with one side face of the paddle blade. If desired, particularly when the lateral force transmitting steering rib is composed of a polymer and is molded on the paddle blade, the lateral force transmitting rib may be relatively thin and may be contoured at its connection a side face of the paddle blade. The shaft, handle and blade of the paddle construction will define a longitudinal centerline and the blade of the paddle will define a free terminal end which is typically of slightly curved or contoured configuration. The lateral force transmitting rib will preferably be located so that one of its ends is located at or near the free end of the paddle blade. The opposite end of the lateral force transmitting rib will be located centrally of one side of the paddle blade and in generally parallel relation with the longitudinal centerline. The respective ends of the lateral force transmitting rib are preferably of inclined or contoured configuration so that no sharp edges or corners are defined that might represent a danger to users.

If the paddle is constructed of wood, the lateral force transmitting rib will preferably also be constructed of wood, connected along its inner side 30 to the paddle face 24 by means of a water resistant adhesive, an epoxy material or other suitable bonding agent. The lateral force transmitting steering element may also be composed of a metal, such as aluminum, stainless steel, etc., and may be connected to the face of the paddle by any suitable bonding agent or adhesive or may be mounted to the paddle blade by screws or other suitable means for connection. If the paddle blade is molded from a polymer material, the lateral force transmitting rib may be integral with the blade as a component of the molding process. If the paddle blade is composed of aluminum or any other suitable metal, the lateral force transmitting rib may be provided with a connecting flange and may be secured to the paddle blade by rivets or other suitable connectors.

OPERATION

A user will grasp the paddle 10 in conventional manner, with one hand grasping the handle 14 and the other hand grasping the paddle shaft 12 at a suitable location along the length thereof Sitting in the boat adjacent one of the gunwales thereof, the user will insert the blade of the paddle into the water with the lateral force transmitting rib facing forwardly, i.e., generally parallel to the surface of the water, and will apply a rearwardly directed force to thus move the boat forwardly. Since the lateral force transmitting rib is facing forwardly it does not apply any force whatever to the water and it does not detract from the force that is being applied to the water by the opposite face of the paddle blade as the paddle blade is moving rearwardly relative to the boat. Thus, the paddling stroke, through use of the paddle of this invention, accomplishes movement of the paddle blade generally in a straight line along the side of the boat from start to finish. All of the force being applied by the paddle during the propulsion stroke acts to propel the boat forwardly in the water.

It should be borne in mind that this rearward force of the paddle will propel the boat forwardly, but being laterally offset from the center-line of the boat, the rearward force will cause the boat to have a slightly curved track or course, curving away from the side on which the paddling force is being applied. Near or at the terminal part of the paddling stroke the blade of the paddle will be oriented nearly parallel with the surface of the water and the lateral force transmitting rib will be oriented transversely to the direction of paddle blade movement in the water, typically oriented downwardly with respect to the paddle blade. At the terminal portion of the paddling stroke the user will pivot the elongate shaft of the paddle against the gunwale of the boat, using a pulling motion with the hand grasping the handle 14 while holding the intermediate portion of the paddle shaft against the gunwale of the boat with the other hand of the user. This pulling motion is oriented so as to move the lateral force transmitting rib away from the boat imparting a laterally directed force against the water and to thus move the stern of the boat laterally toward the direction of curvature imparted by the initial portion of the paddling stroke. The paddle is not rotated about its axis during the complete paddling stroke as is the case with the "J" stroke so that the lateral force transmitting rib remains facing forwardly during virtually all of the boat propulsion stroke and does not impart any force to the water that might tend to retard forward propulsion of the boat. After the forward propulsion portion of the paddling stroke has been completed the paddle shaft is pivoted against the gunwale of the boat by a pulling action on the handle of the paddle with one hand while holding the paddle shaft in engagement with the gunwale of the boat with the other hand of the user. The net result is that the tendency of the boat to curve in the water is corrected without detracting from the propulsion force imparted by the paddle and the boat will move along a substantially straight course even though paddling is occurring only on one side of the boat. Unlike the "J" stroke, the "straight course" paddling stroke, using the paddle of the present invention is easy to learn. In fact, except for the lateral pivoting portion of the stroke, the stroke is identical with a paddling stroke that is accomplished through the use of a conventional paddle. There is no need for rotation of the paddle in the water as is the case with the "J" stroke. The paddle is simply moved straight along the side of the boat by the paddling stroke causing virtually all of the manual energy that is applied to be used in the forward propulsion of the boat. For course correction at the end of the paddling stroke, the lateral pivoting portion of the paddling stroke is simple and energy efficient because the paddle is pivoted intermediate the length of the shaft against the gunwale of the boat, using the mechanical advantage of leverage and by using a pulling force rather than a more upright pushing force as is the case with the "J" stroke. The course correcting paddling that is accomplished through use of the paddle construction of this invention is energy efficient and is simple and easy to learn. During the paddling stroke the lateral force transmitting rib is always properly positioned for boat course correction so that the user, at any portion of the paddling stroke, can pivot the paddle shaft against the gunwale of the boat and can then complete the paddling stroke. Thus, the paddle construction of the present invention makes controlled boat paddling much easier and more pleasurable as compared with the use of conventional boat paddles.

In view of the foregoing, it is evident that the present invention is one well adapted to attain all of the objects and features that are hereinabove set forth, together with other objects and features which are inherent in the apparatus disclosed herein.

As will be readily apparent to those skilled in the art, the present invention may be produced in other specific forms without departing from its spirit, scope and essential characteristics. The present embodiment is therefore to be considered as illustrative and not restrictive, the scope of this invention being defined by the claims of a utility patent application based hereon rather than by the foregoing description, and all changes which come within the meaning and range of equivalence of the claims are therefore intended to be embraced therein.

What is claimed is:

1. A paddle for watercraft, comprising:

(a) an elongate shaft;

(b) a paddle blade being disposed in fixed relation with said elongate shaft, said blade defining edges and defining opposed blade sides and defining a free terminal end, said elongate shaft and said paddle blade defining a longitudinal center-line; and (c) a lateral force transmitting steering rib being in fixed relation with said paddle blade and projecting from only one of said blade sides and being disposed in substantially normal relation therewith, said lateral force transmitting steering rib extending substantially from said free terminal end of said paddle blade and parallel with said longitudinal center-line to a location intermediate the length of said paddle blade and having a width exceeding the width of said elongate shaft.

2. The paddle of claim 1 wherein:

said lateral force transmitting rib extending along from about one-third to about one-half of the length of said blade.

3. The paddle of claim 1 wherein:

(a) said handle, shaft and blade being composed of wood, said free terminal end being located opposite said handle; and (b) said lateral force transmitting rib being composed of wood and being bonded to one of said blade sides and extending from said free terminal end of said blade and along at least a portion of said blade.

4. The paddle of claim 1 wherein:

(a) said blade being composed of polymer and having said free terminal end located opposite said handle;

(b) said elongate shaft having a shaft dimension; and (c) said lateral force transmitting steering rib being composed of polymer material being integrally connected with said blade and being oriented in perpendicular relation with said center-line and with said one blade side and extending from said free terminal end of said blade and along at least a portion of said paddle blade and having a width exceeding said shaft dimension.

5. The paddle of claim 1 wherein:

said lateral force transmitting steering rib defining substantially parallel side faces each being oriented in substantially perpendicular relation with said one side of said blade.

* * * * *